United States Patent [19]

Moynihan

[11] 4,047,665

[45] Sept. 13, 1977

[54] SPRAY CONTROL SYSTEM

[76] Inventor: William N. Moynihan, 9646 S. Springfield, Evergreen Park, Ill. 60642

[21] Appl. No.: 631,822

[22] Filed: Nov. 14, 1975

[51] Int. Cl.[2] ..... B05B 9/00; F04B 49/02

[52] U.S. Cl. ..... 239/124; 417/22; 417/293; 417/301

[58] Field of Search ..... 239/124, 126, 127; 137/569; 417/18, 22, 24, 26, 31, 34, 293, 299, 301-303, 307, 309; 200/157

[56] References Cited

U.S. PATENT DOCUMENTS

| | | | |
|---|---|---|---|
| 2,791,664 | 5/1957 | Rohacs | 200/157 |
| 3,147,767 | 9/1964 | Goss | 239/127 X |
| 3,246,845 | 4/1966 | Techler et al. | 239/124 X |
| 3,433,415 | 3/1969 | Enssle | 239/127 X |
| 3,438,583 | 4/1969 | Lawrence | 239/305 |
| 3,827,827 | 8/1974 | Hill | 417/28 |

*Primary Examiner*—Evon C. Blunk
*Assistant Examiner*—Andres Kashnikow
*Attorney, Agent, or Firm*—Thomas R. Vigil

[57] ABSTRACT

The control system is utilized in a high pressure liquid spraying system including an internal combustion engine, a pump driven by the engine, a source of liquid connected to the pump and a spray nozzle assembly connected by a high pressure conduit to the output of the pump. The control system includes an enclosure and a valve assembly mounted near the pump. The valve assembly is operated by an electric switch mounted on the nozzle assembly and connected to a first solenoid valve in a hydraulic system for operating the valve assembly. The valve assembly includes a hydraulic cylinder which is mounted on the enclosure and which has a plunger positioned to open a ball valve of the valve assembly which is mounted within the enclosure and which is connected to the output of the pump. At engine idle, the first solenoid valve supplies engine oil pressure to the hydraulic cylinder whereby the plunger is urged against the ball valve to open the same to permit water to be dumped, with the enclosure cushioning the discharge of water from the ball valve. The control system also includes a second solenoid valve in a hydraulic system including a cylinder for advancing the engine throttle to increase the pressure of the water being pumped. At engine idle, this second solenoid valve connects the throttle advancing cylinder to an engine oil return manifold. Operation of the electric switch causes the first solenoid valve to connect the hydraulic cylinder to the engine oil return manifold whereby the ball valve can close so that pressurized water is supplied to the spray nozzle assembly. Operation of the switch also causes the second solenoid valve to connect the throttle advancing cylinder to engine oil pressure to accelerate the engine to increase the water pressure.

10 Claims, 7 Drawing Figures

SPRAY CONTROL SYSTEM

BACKGROUND OF THE INVENTION

1. Field of the Invention

The field of the invention is a control system for a high pressure liquid spraying system.

2. Description of the Prior Art

In recent years the use of a high pressure water spray, 500 to 20,000 psi, for removing or cleaning off the build up of material on exterior surfaces has become very widespread particularly since water is not harmful to the environment. Some examples of surfaces which are easily cleaned with a high pressure water spray are: the bottom of a ship where marine growth accumulates, the walls of a paint booth were coats of paint build up, and the exterior of an engine block where grease, grit and grime build up.

A typical high pressure water spraying system includes an internal combustion engine, a pump driven by the engine, a source of water connected to the pump and a spray nozzle assembly connected by a high pressure conduit to the output of the pump.

In many such systems, the nozzle assembly includes a nozzle with a small orifice and a trigger operated dump valve for dumping water from the nozzle assembly when the trigger is released. Of course, when the trigger is depressed the pressurized water flows to the nozzle and out the orifice. The pressure of the water can be controlled by pre-setting the engine throttle or, alternatively, the engine throttle can be remotely controlled by means of an electric switch on the nozzle assembly.

Dumping of water at the place where the spray cleaning is being done is often inconvenient, ackward and messy. Also, it is tedious and tiring for the operator to hold a trigger depressed for an extended period of time against a significant spring pressure of a biasing spring in a conventional dump valve.

As a result, it has been proposed to provide some sort of relief at or near the pump, or recirculation through the pump, of pressurized liquid in a liquid spraying system such as in a high pressure water cleaning system. Also it has been proposed to have a remote control for the relief or recirculation. Examples of liquid spraying systems having some sort of relief or recirculation at or near the pump are disclosed in:

U.S. Pat. Nos. 1,280,477; 3,433,415; 3,827,827.

As will be described in detail hereinafter the control system of the present invention differs from the previously proposed systems by not only eliminating dumping of liquid at the place where cleaning is being done by dumping at the pump, but also by providing for cushioning of the discharge of the pressurized liquid being dumped and by providing for remote control of both dumping and engine acceleration with a single, easily movable trigger mounted on the nozzle assembly of the spraying system.

SUMMARY OF THE INVENTION

According to the invention there is provided in a high pressure, liquid spraying system including an internal combustion engine, a pump driven by the engine a source of liquid connected to the pump and a spray nozzle assembly connected by a high pressure conduit to the output of the pump, the improvement comprising spray control means for controlling the pressure of liquid in and the flow of liquid to the spray nozzle assembly, for causing dumping of unneeded pressurized liquid at a location adjacent the pump, and for cushioning the discharge of dumped liquid, said control means being electrically operated and including hand manipulatable electric switch means mounted on the nozzle assembly for operating said control means.

DESCRIPTION OF THE PREFERRED EMBODIMENTS

Figure 1:
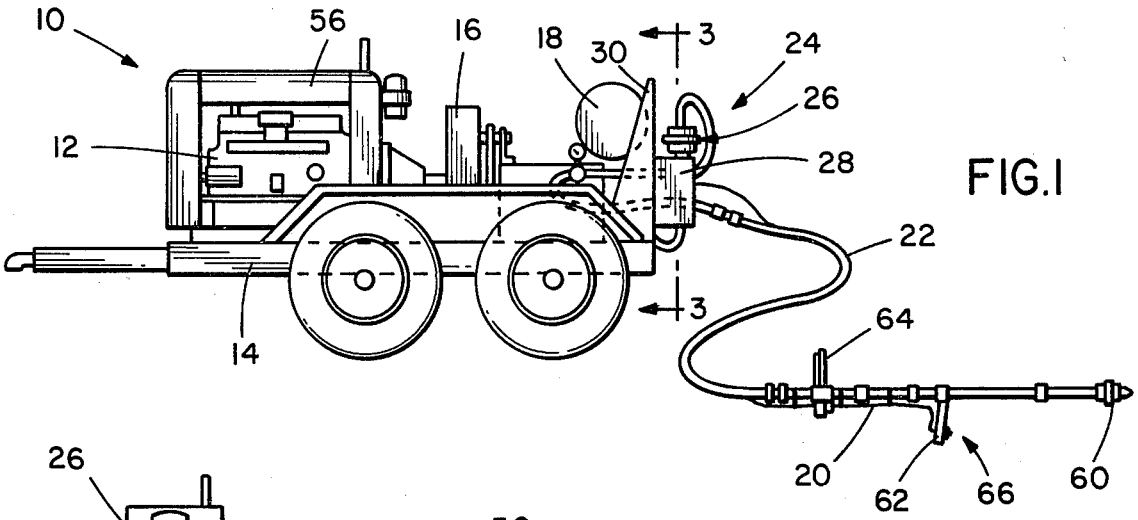
FIG. 1 is a side elevational view of a trailer mounting a high pressure water spraying system incorporating the spray control system of the present invention.
Figure 2:
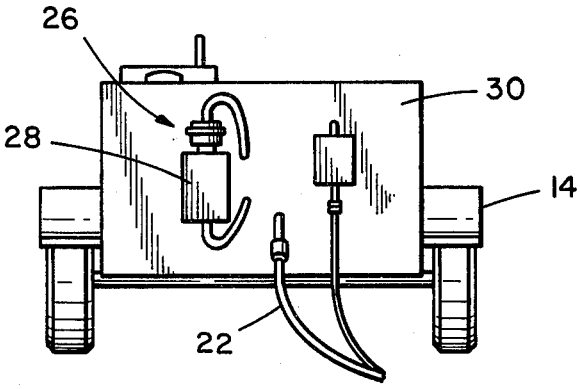
FIG. 2 is an end elevational view of the rear end of the trailer shown in FIG. 1.

In FIG. 1 there is illustrated a high pressure water spraying system generally identified by reference numeral 10. The system 10 includes an internal combustion engine 12 supported on a trailer 14 and a pump 16 also supported on the trailer 14 and driven by the engine 12. The spraying system 10 also includes a water tank 18, which is mounted on the trailer 14 and connected to the input of the pump 16, and a nozzle assembly 20 connected by a high pressure conduit 22 to the output of the pump 16.

The control system of the present invention is generally identified by reference numeral 24 and includes a valve assembly 26, a portion which is mounted in an enclosure or housing 28 mounted on a rear end panel 30 of the trailer 14.

Figure 3:
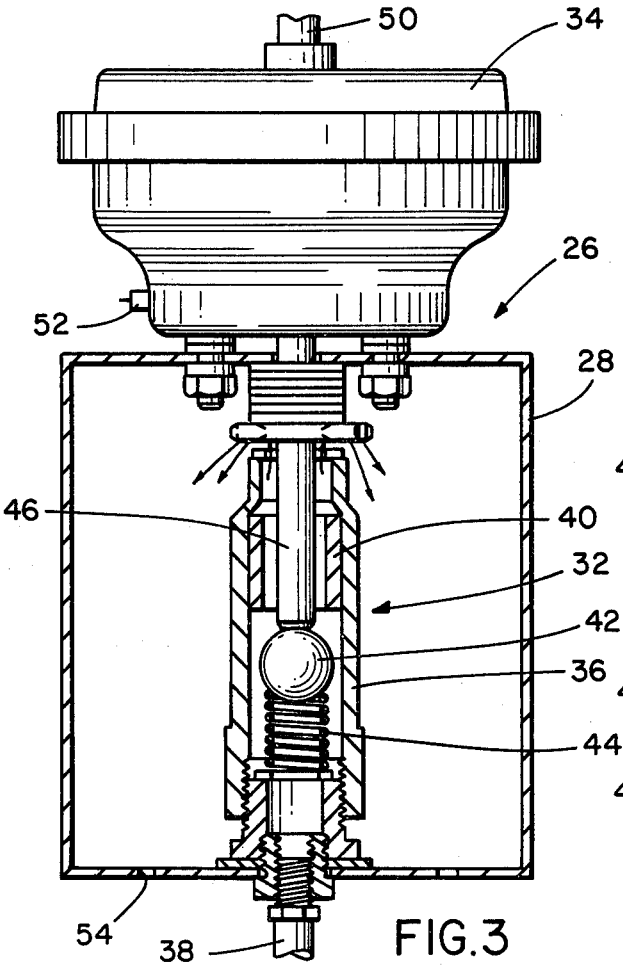
FIG. 3 is a vertical view partially in section of a valve assembly and a housing mounted on the rear end of the trailer and forming part of the spray control system of the present invention.
Figure 4:
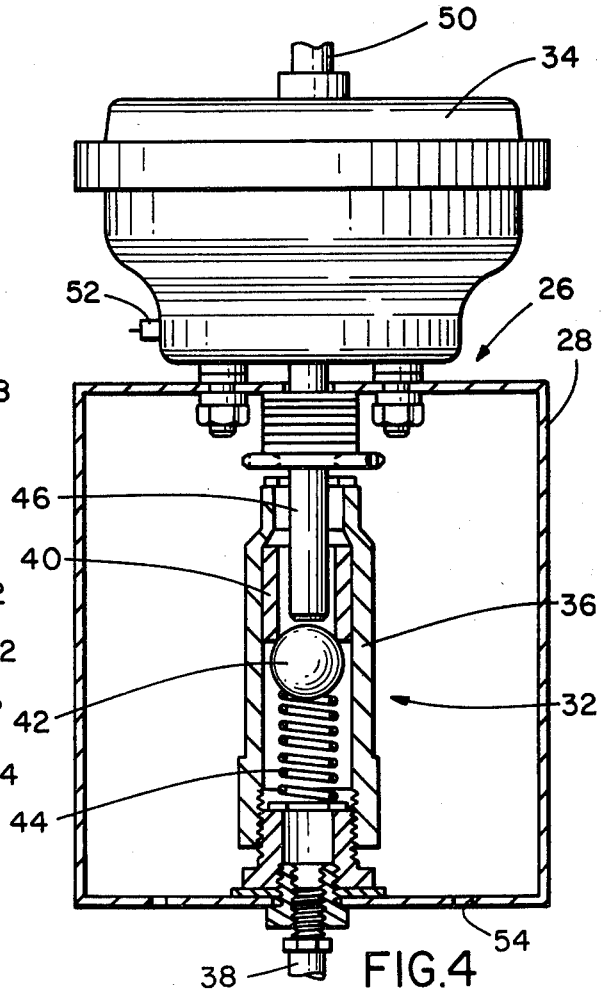
FIG. 4 is a view substantially identical to FIG. 3 but showing the change in positions of a plunger and a ball valve of the valve assembly after a trigger mechanism of the control system has been operated.

As best shown in FIG. 3, the valve assembly 26 includes a ball valve 32 mounted within the housing 28 and a so called "pancake" type hydraulic cylinder 34 mounted on the top of the housing 28. The ball valve 32 includes a tubular portion or pipe 36 having a lower end thereof mounted on the bottom of the housing 28 and coupled via a hose 38 to the output of the pump 16. The upper end of the pipe 36 is open. Inside the pipe 36 is a valve seat 40 and a ball 42 which seats against the valve seat 40. As shown, a spring 44 is mounted within the pipe 36 in position to bias the ball 42 against the valve seat 40.

The hydraulic cylinder 34 is of the type that includes a diaphragm (hidden from view inside the cylinder 34) which is moved in response to liquid pressure applied to one side of the diaphragm. The other side of the diaphragm acts against a plunger 46. As shown, the hydraulic cylinder 34 is mounted on the top of the housing 28 and the plunger 46 extends through an opening in the top of the housing 28 into the upper end of the pipe 36 of the ball valve 32. The hydraulic cylinder 34 is controlled by a hydraulic system or circuit (circuit 68 in FIG. 5) which forms part of the control system 24 of the present invention. As described in detail in connection with the description of FIG. 5 the hydraulic circuit controls the delivery of the relief of engine oil pressure to and from the hydraulic cylinder 34 via a conduit 50. A relief valve 52 relieves pressure from the other side of the hydraulic cylinder 34.

According to the teachings of the present invention the control system 24 is operable when the engine 12 is at idle to supply oil pressure to the hydraulic cylinder 34 to cause the plunger 46 to extend from the cylinder 34 into pipe 36 and against ball 42 to open the ball valve 32 as shown in FIG. 3. At this time water will escape from the ball valve as indicated in FIG. 3 and the housing 28 will cushion the discharge of water being dumped from the ball valve 32; and holes 54 in the bottom of the housing 28 permit easy flow of the dumped water from the housing 28.

Also, the plunger 46 will be extended when the operator stops spraying so that the pressurized water can be immediately dumped from the outlet of the ball valve 42 with the discharge of the pressurized water being cushioned by the housing 28 and being dumped at a position adjacent the pump 16 instead of at a place where the spray cleaning is being done.

When the nozzle assembly 20 is actuated to cause high pressure water to be sprayed therefrom, a hydraulic circuit (circuit 68) causes the hydraulic cylinder 34 to be connected to an engine oil return manifold 56 (FIG. 1). As a result, oil pressure on the diaphragm within the cylinder 34 is relieved and the plunger 46 returns to its at rest position under the force of spring 44 acting against ball 42. Of course this also results in the ball 42 seating on the valve seat 40 thereby closing the ball valve 32. When this occurs, full water pressure is supplied to the nozzle assembly 20. At the same time, and as will be described below in connection with the description of FIG. 5, the engine throttle is advanced to accelerate the engine thereby to accelerate the pump 16 and increase the pressure of the water being supplied to the nozzle assembly 20.

Figures 5, 6, 7:
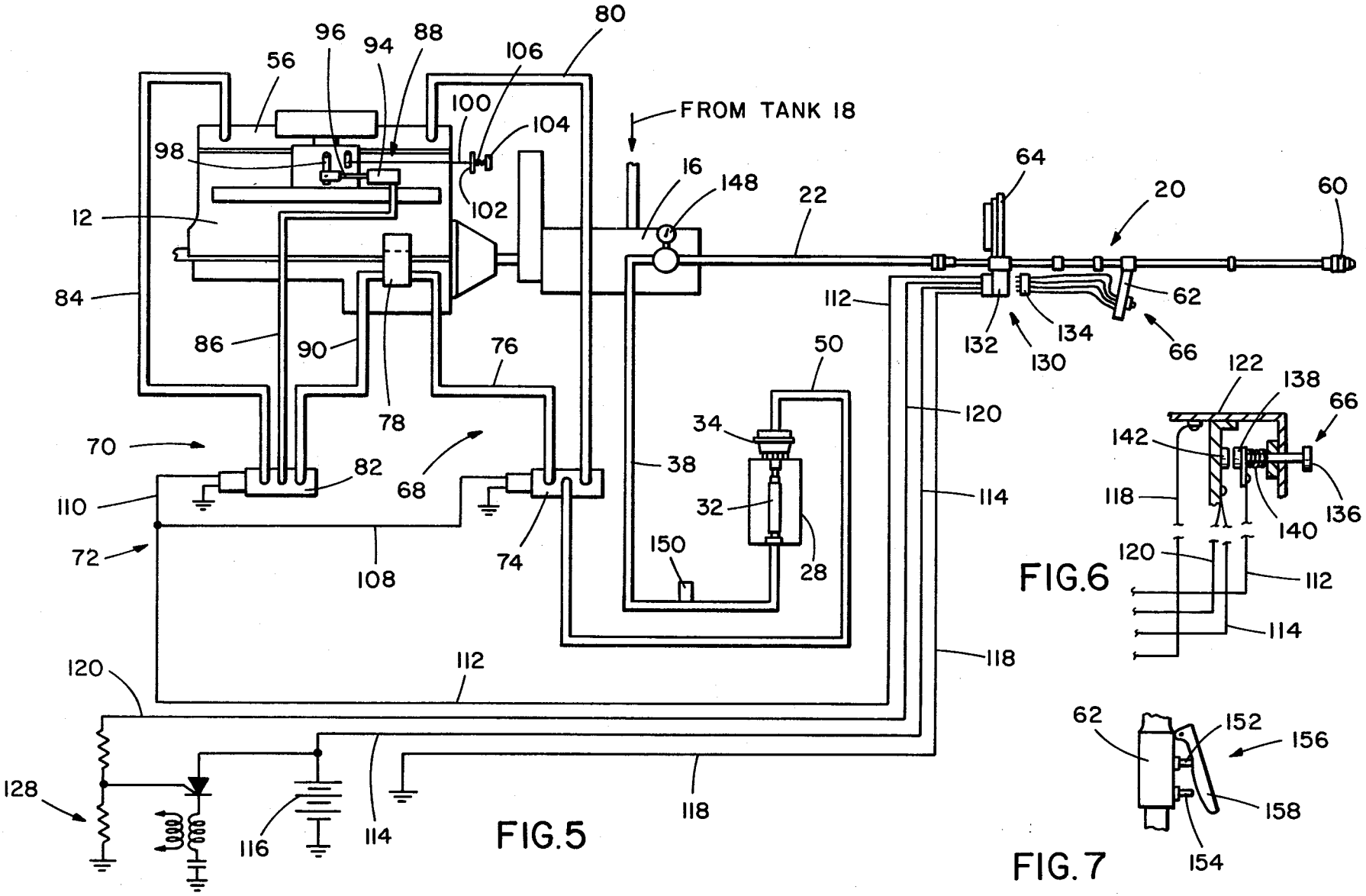
FIG. 5 is a schematic hydraulic and electrical circuit diagram of the spray control system of the present invention.
FIG. 6 is an enlarged fragmentary sectional view of a switch forming the trigger mechanism.
FIG. 7 is an enlarged fragmentary view of an alternate triger mechanism incorporating two switches which are operated sequentially.

As shown in FIGS. 1 and 5, the nozzle assembly 20 includes a nozzle 60 having a small outlet orifice (not shown), a hand grip 62 and a shoulder brace 64. Mounted on the hand grip 62 is a trigger mechanism 66 forming part of the control system 24 of the present invention. In the embodiment illustrated in FIGS. 1, 5 and 6 the trigger mechanism 66 is a push button electric switch which is easy to operate and maintain depressed by an operator holding the nozzle assembly 20.

Referring now to FIG. 5, the control system 24 includes first and second hydraulic systems or circuits 68 and 70 and an electrical circuit 72 in addition to the valve assembly 26, the housing 28 and the trigger mechanism or switch 66.

The first hydraulic circuit 68 includes a first solenoid valve 74 which is connected via the conduit 50 to the hydraulic cylinder 34. Another conduit 76 is connected between the solenoid valve 74 and a source of engine oil pressure, namely, an engine oil pump 78. Still another conduit 80 is connected between the solenoid valve 74 and the engine oil return manifold 56.

The second hydraulic circuit 70 includes a second solenoid valve 82, a conduit 84 connected between the solenoid valve 82 and the engine oil return manifold 56, a conduit 86 connected between the solenoid valve 82 and an engine acceleration control apparatus 88, and a conduit 90 connected between the solenoid valve 82 and the engine oil pump 78. The engine acceleration control apparatus 88 includes a cylinder 94 having a piston rod 96 extending therefrom and connected to a throttle member 98 of the engine 12. The throttle member is connected, such as by a pantograph mechanism (not shown), to a throttle control rod 100. The other end of the rod 100 extends through a plate 102 and is connected to a stop 104. A spring 106 is situated on the rod 100 between the plate 102 and the stop 104 and biases the rod 100 to an engine idle position shown in FIG. 5. The plate 102 or the stop member 104 is adjustable so that the length of travel of the rod 100 can be altered.

When oil pressure is supplied to the cylinder 94, the piston rod 96 is moved outwardly to move the throttle member 98 against the action of the spring 106 until the spring 106 is compressed and the stop 104 is adjacent the plate 102. At that time, the engine throttle will be at some pre-set position and as stated above this pre-set position can be altered as desired by adjusting plate 102 or stop 104.

As shown, the electrical circuit 72 includes a conductor 108 connected to one side of the solenoid valve 74, the other side of which is connected to ground, and a conductor 110 connected to one side of the solenoid valve 82, the other side of which is also connected to ground. The conductors 108 and 110 are connected to another conductor 112 leading to one side of the switch 66. In the illustrated embodiment the electrical circuit 72 also includes a return conductor 114 from the other side of the switch 66 to the positive side of a battery 116.

Also, as a safety measure, two other conductors 118 and 120 are connected between the switch 66 and the electrical circuit for the engine 12. In this respect, the conductor 118 is a "ground" wire for grounding the nozzle assembly 20. As shown, conductor 118 is connected between ground and a metal casing 122 of the switch 66. The casing 122 is in metal to metal contact with the metal structure of the nozzle assembly 20.

The conductor 120 is connected between the same side of the switch 66, as is conductor 114 leading to the positive side of the battery 116, and an ignition control circuit 128 for the engine 12. With this arrangement, the conductor 120 is always "live" regardless of the position of the switch 66 and carries a small current to the ignition control circuit 128.

All four conductors 112, 114, 118 and 120, are connected through a disconnect device 130 which, in the illustrated embodiment, comprises a female plug 132 and a male plug 134. This disconnect device 130 permits the operator to stop the engine if for some reason he loses control at the nozzle assembly 20. In other words, if there is a break down of the hydraulic or electrical circuits rendering the switch 66 ineffective in controlling the system 10, the operator can pull out the plug 134 to de-energize the ignition control system 128 thereby to stop the engine 12.

Referring to FIG. 6, the mechanism or switch 66 includes a depressible button 136 made of an insulating material and having a first metal contact 138 mounted on the inner end thereof. As shown a spring 140 is positioned between the underside of the button 136 and the casing 122. The wire conductor 112 is connected to the metal contact 138. A second metal contact 142 is mounted in a fixed position within the casing 122 opposite the movable contact 138. The conductors 114 and 120 are connected to the stationary contact 142. It will be readily apparent that depression of the button 136 will close an electrical circuit between the positive side of the battery 116 and the solenoid valves 74 and 82, i.e., via conductor 114 and conductor 112.

As shown in FIG. 5 water is supplied from the tank 18 to the input of the pump 16 and the output of the pump 16 is connected to a pressure gauge 148, to the high pressure conduit 22 and to the hose or conduit 38 leading to the ball valve 32. Also, a relief valve 150 is provided at the output of the pump 16 and is shown connected to the conduit 38.

In operation, an operator will first start the engine 12 which will then operate an idle. At engine idle, each of the solenoid valves 74 and 82 is de-energized. In the deenergized position, the valve 74 connects conduit 74 to conduit 50 whereby engine oil pressure is supplied to the hydraulic cylinder 34 to cause the plunger 46 to extend therefrom to open the ball valve 32. In this position low pressure water from the pump 16 is dumped into the housing 28.

In the de-energized position, the valve 82 connects the conduit 84 to the conduit 86 so that the throttle advancing cylinder 94 is connected to the engine oil return manifold 56.

Upon actuation of the triger mechanism or switch 66, i.e., upon depression of the button 136, both solenoids 74 and 82 are energized. When energized the solenoid valve 74 connects conduit 80 to conduit 50 so that engine oil pressure is relieved from the hydraulic cylinder 34 allowing the ball valve 32 to move to a closed position; and solenoid valve 82 connects the conduit 90 to the conduit 86 to supply engine oil pressure to the cylinder 94 to advance the engine throttle to the pre-set position determined by plate 102 and stop 104.

The engine is then accelerated whereby, at substantially the same time the valve assembly 26 for dumping water is closed, the water pressure is increased by speeding up the pump 16. High pressure water is then sprayed from the nozzle 60 and directed at the surface to be cleaned.

When the operator is finished spraying, he will release the trigger or switch 66 which immediately de-energizes the solenoids 74 and 82. This causes the ball valve 32 to be opened so that the high pressure water can be immediately dumped into the housing 28. At substantially the same time the engine 12 is decelerated by reason of the throttle mechanism 98 moving to its original position, as shown in FIG. 5, under the action of the spring 106 when the cylinder 94 is reconnected through the solenoid valve 82 to the engine oil return manifold 56.

From the foregoing description it will be apparent that the control system 24 of the present invention has a number of advantages some of which have been described above and others of which are inherent in the control system 24 of the present invention. Also it will be apparent that obvious modifications can be made to the control system 24 without depending from the spirit or scope of the invention. In this respect, instead of connecting the conductors 108 and 110 to a single conductor 112, each of the conductors 108 and 110 can be connected to separate switches 152 and 154 mounted on the hand grip 62 as shown in FIG. 7. The switches 152 and 154 form part of an alternate trigger mechanism 156 which also includes a handle or trigger 158 configured as shown and operable upon depression thereof to close switch 152 and second to close switch 154. This trigger mechanism 156 provides for a two stage operation. When the trigger 158 is depressed the switch 152 is closed first to energize solenoid valve 82 to accelerate the engine 12. Then switch 154 is closed second to close the ball valve 32 so that high pressure water is supplied to the nozzle assembly 20. On release of the trigger 158, first the ball valve 32 is opened to dump high pressure water, and second the engine 12 is decelerated to lower the water pressure.

Accordingly, the scope of the present invention is only to be limited as necessitated by the accompanying claims.

I claim:

1. In a high pressure, liquid spraying system including an internal combustion engine, a pump driven by the engine, a source of liquid connected to the pump and a spray nozzle assembly connected by a high pressure conduit to the output of the pump, the improvement comprising spray control means for controlling the pressure of liquid in and the flow of liquid to the spray nozzle assembly, for causing dumping of unneeded pressurized liquid at a location adjacent the pump and for cushioning the discharge of dumped liquid, said control means being electrically operated and including dump valve means adjacent the pump for dumping pressurized liquid, an enclosure surrounding said dump valve means and having openings therethrough, said enclosure serving to cushion the dumping of pressurized liquid from said dump valve means and said openings permitting easy flow of dumped liquid from said enclosure into the ambient environment, and hand manipulatable electric switch means mounted on the nozzle assembly for operating said dump valve means.

2. The system according to claim 1 wherein said dump valve means includes a valve assembly which is connected to the output of the pump adjacent the pump and which is normally open during idling of the engine to dump low pressure liquid being pumped by the pump, said switch means being operable to cause closing of said valve assembly to cause pressurized liquid to be supplied to the nozzle assembly.

3. The system according to claim 2 wherein said control means includes an engine acceleration control apparatus operated by said switch means to cause acceleration of the engine and pump connected thereto to increase the pressure of the liquid supplied to the nozzle assembly when said switch means is operated to close said valve assembly.

4. The system according to claim 3 wherein said switch means includes first and second electric switches and a trigger movable in one direction to cause operation of said switches sequentially in two stages, said first switch being operated first upon initial movement of said trigger, to complete an electric circuit to cause closing of said valve assembly, and said second switch being operated second upon further movement of said trigger, to complete an electric circuit which causes operation of said acceleration control apparatus to accelerate the engine.

5. The system according to claim 3 wherein said switch means includes a single electric switch which, when operated, makes or breaks electric circuits which cause closing or opening of said valve assembly and which cause substantially simultaneous acceleration or deceleration of the engine.

6. The system according to claim 5 wherein said electric circuits are connected to said switch means through a disconnect device on the nozzle assembly and include a circuit which is continuously closed through said switch means, which is connected to an ignition control circuit and which is opened to stop the engine upon opening of said disconnect device.

7. The system according to claim 3 wherein said engine acceleration control apparatus includes a piston and cylinder mechanism having a piston rod connected to a spring biased engine throttle, a solenoid valve electrically connected to said switch means, a first conduit connected between said solenoid valve and an engine oil return manifold, a second conduit connected between said solenoid and said piston and cylinder mechanism and a third conduit connected between said solenoid valve and a source of engine oil pressure, said solenoid valve being, at engine idle, in a position connecting said second conduit to said first conduit and being moved to a position connecting said second conduit to said third conduit upon operation of said switch means.

8. The system according to claim 2 wherein said enclosure comprises a housing mounting said valve assembly and wherein said valve assembly includes a ball valve which is mounted within said housing and which is biased to a closed position and a hydraulic cylinder which is mounted on the outside of said housing and which has a plunger extending therefrom into said housing for engaging and opening said ball valve, said housing, upon opening of said ball valve serving to cushion the discharge of liquid from said ball valve.

9. The system according to claim 8 wherein said control means includes a solenoid valve electrically connected to said switch means, a first conduit between said solenoid valve and a source of engine oil pressure, a second conduit between said solenoid valve and said hydraulic cylinder, and a third conduit between said solenoid valve and an engine oil return manifold, said solenoid valve being, at engine idle, in a position connecting said second conduit to said first conduit and being moved to a position connecting said second conduit to said third conduit upon operation of said switch means.

10. The system according to claim 1 wherein said enclosure comprises a housing, and said dump valve means comprises a valve assembly including a ball valve which is mounted within said housing, which is connected to the output of the pump adjacent the pump and which is normally open during idling of the engine to dump low pressure liquid and a hydraulic cylinder which is mounted on the outside of said housing and which has a plunger extending therefrom into said housing for engaging and opening said ball valve, a first solenoid valve electrically connected to said switch means, a first conduit connecting said solenoid valve to a source of engine oil pressure, a second conduit connecting said solenoid valve to said hydraulic cylinder, a third conduit connecting said solenoid valve to an engine oil return manifold, said solenoid valve, at engine idle, being in a position connecting said second conduit to said first conduit whereby said valve assembly is maintained open, an acceleration control apparatus including a piston and cylinder mechanism having a piston rod connected to a spring biased engine throttle, a second solenoid valve electrically connected to said switch means, a fourth conduit connected between said second solenoid valve and an engine oil return manifold, a fifth conduit connected between said second solenoid valve and said piston and cylinder mechanism, a sixth conduit connected between said second solenoid valve and a source of engine oil pressure, said second solenoid valve being, at engine idle, in a position connecting said fifth conduit to said fourth conduit whereby the engine throttle is maintained at an idle position and said switch means including a single button switch which, upon depression thereof, completes an electric circuit to said first solenoid to cause the same to connect said second conduit with said third conduit to relieve pressure on the hydraulic cylinder to allow said ball valve to close whereby pressurized liquid is delivered to the nozzle assembly and substantially simultaneously completes an electric circuit to said second solenoid valve to cause the same to connect said fifth conduit to said sixth conduit to apply pressure to said piston and cylinder mechanism to cause acceleration of the engine to increase the pressure of the liquid being pumped and which, upon release thereof, causes opening of said ball valve to dump liquid at the pump and substantially simultaneously causes a reduction in engine speed to reduce the liquid pressure.

* * * * *